US005605526A

United States Patent [19]

Hatfield

[11] Patent Number: 5,605,526

[45] Date of Patent: Feb. 25, 1997

[54] EXERCISE DEVICE

[76] Inventor: Steven L. Hatfield, 1630A 30th St. Box 496, Boulder, Colo. 80301

[21] Appl. No.: 417,091

[22] Filed: Apr. 5, 1995

Related U.S. Application Data

[63] Continuation of Ser. No. 105,014, Aug. 10, 1993, abandoned.

[51] Int. Cl.[6] ..... A63B 23/02

[52] U.S. Cl. ..... 482/142; 482/129

[58] Field of Search ..... 482/129, 130, 482/142; 297/3, 79, 2, 270, 258, 259; 606/237; 472/114

[56] References Cited

U.S. PATENT DOCUMENTS

| | | | |
|---|---|---|---|
| 4,241,949 | 12/1980 | Parker | 482/142 |
| 4,367,870 | 1/1983 | Birch | 482/142 |
| 4,653,748 | 3/1987 | Seel et al. | 482/79 |
| 5,080,353 | 1/1992 | Tench | 482/130 |

FOREIGN PATENT DOCUMENTS

| | | | |
|---|---|---|---|
| 2310678 | 9/1974 | Germany | 482/130 |

*Primary Examiner*—Jerome Donnelly

*Attorney, Agent, or Firm*—Woodard, Emhardt, Naughton Moriarty & McNett

[57] ABSTRACT

A device for use in stimulating blood flow and providing stress relief. The device includes curved sides shaped to permit a user to rock back and forth on a flat surface. Five pair of handles are cut through the sides at various positions to help the user maintain a secure position while seated on the device and to facilitate aggressive modes of exercise. The handles are teardrop shaped to allow the user to select a gripping position wherein the gripping surface is generally perpendicular to the direction of pull. The device is designed to rock backwards and remain in that position, thereby placing the user in a supine position and raising the user's feet above his head. While so positioned, the user may perform many different exercises or may simply assume the supine position and rest while gravity drains the blood and fluid from her lower extremities. The user may also enjoy cardiovascular stimulation and stress relief when rocking the device.

29 Claims, 6 Drawing Sheets

EXERCISE DEVICE

This application is a continuation of application Ser. No. 08/105,014, filed Aug. 10, 1993, (status now pending, etc.).

FIELD OF THE INVENTION

The present invention relates generally to exercise devices, and more particularly to exercise devices for stress relief and stimulation of blood flow.

BACKGROUND OF THE INVENTION

The ever-increasing urbanization and mechanization of modern society has led to a corresponding increase in the stress experienced by its members. Physicians and physical fitness experts have long known that regular physical exercise can relieve such stress by increasing blood flow to the brain. For those who cannot engage in strenuous exercise, whether by infirmity or by time constraints, doctors recommend that these persons at least put their feet up above the level of their heart for a few minutes each day. This position allows blood and fluid to drain from the lower extremities and bathe the brain in oxygen and nutrients. Not only does this position tend to reduce stress by relaxing the body, it also provides a measure of cardiovascular exercise because the heart must pump harder to provide blood to the lower extremities.

A variety of devices to facilitate upside down relaxation and/or exercise have been developed by the art. For example, one popular product includes boots attachable to a horizontal bar so that the wearer may hang upside down. Similarly, exercise benches having an elevated end equipped with a bar or other means to restrain a user's feet above his head are used for vigorous exercise in many gyms.

For more casual uses, chairs which rock backward until the user's feet are positioned over his head have been disclosed. These chairs promote relaxation as well as exercise, and are known to promote good health by stimulating the flow of blood to the user's head. U.S. Pat. No. 4,367,870 to Birch, and U.S. Pat. No. 4,902,003 to Buoni disclose such devices.

Significantly, the invertible exercise chairs of the prior art have not provided handholds to permit a user to stabilize his position within the device. This limits the positions which can easily be obtained by failing to provide adequate means for stabilizing the user in the chair.

A need therefore exists for an exercise chair which provides a safe, stable base from which a user can engage in upside down exercise and/or relaxation, with handholds to facilitate stabilizing the user in the chair. The present invention addresses that need.

SUMMARY OF THE INVENTION

Briefly describing one aspect of the present invention, there is provided an exercise chair for use in stimulating blood flow and relieving stress. The chair comprises a seat, a back, and two curved sides. The curved sides serve as rockers and enable a user to rock the chair back until the user's feet are elevated well above the user's head. A plurality of apertures, or handholds, are provided in the side members to enable a seated user to grip the chair at various predetermined locations—thereby stabilizing the user in the chair. The handles are teardrop shaped to allow the user to select a gripping position wherein the gripping surface is generally perpendicular to the direction of pull. The invention allows the user to rock the device back and forth, or to rock the device backwards and remain in a stable, supine position.

One object of the present invention is to provide a chair that easily rocks backward to a stable and partially-inverted orientation, so that a user's feet may be maintained in an elevated position.

Another object of the present invention is to provide a chair having handholds for an upside down user, so that the user may be stabilized in the chair.

A further object of the present invention is to provide a chair having multiple handholds, so that users of a variety of arm lengths may be accommodated.

Further objects and advantages of the present invention will be apparent from the following description.

DESCRIPTION OF THE PREFERRED EMBODIMENT

Figure 1:
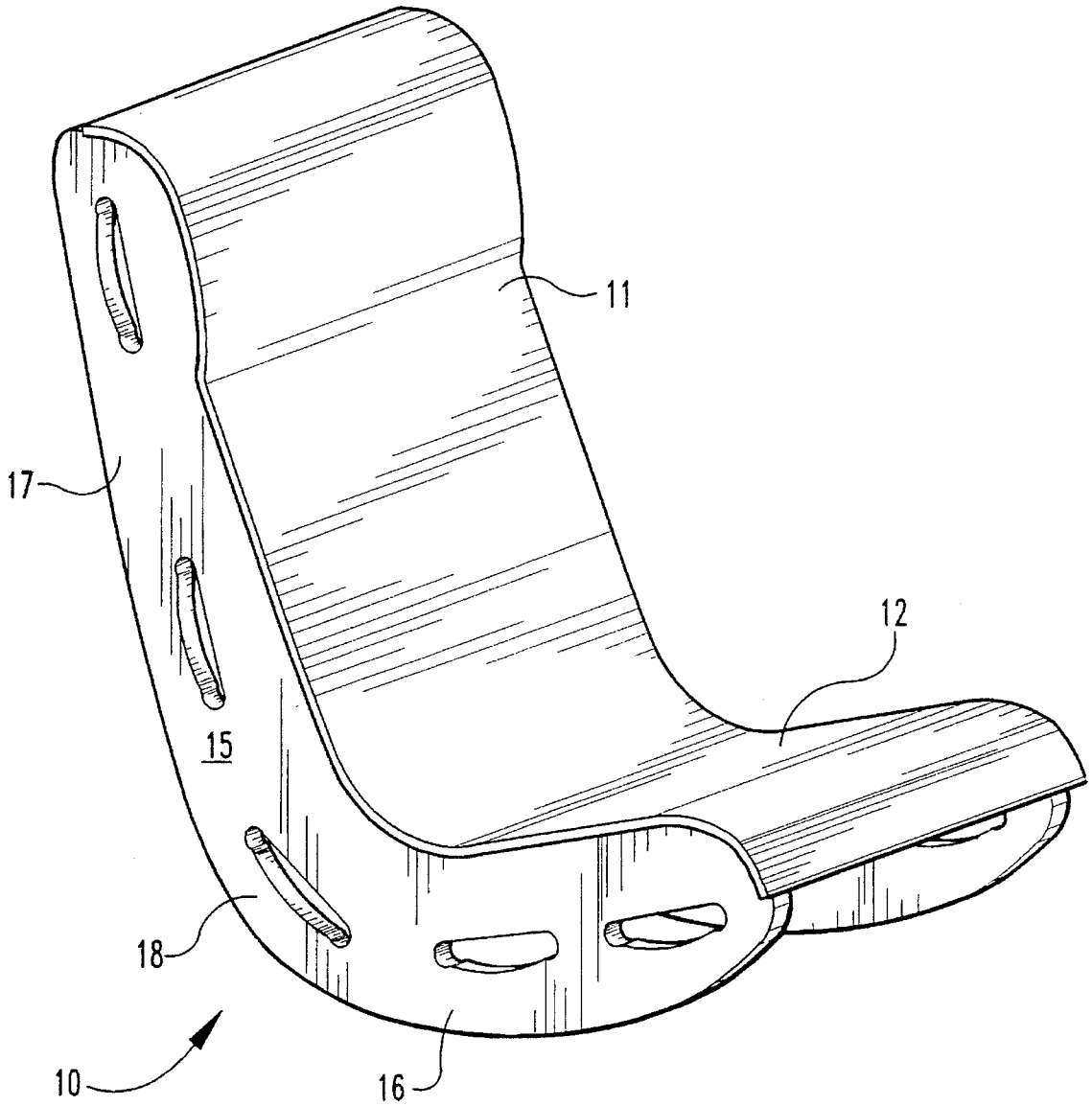
FIG. 1 is a perspective view of the exercise chair of the present invention according to one preferred embodiment.
Figure 2:
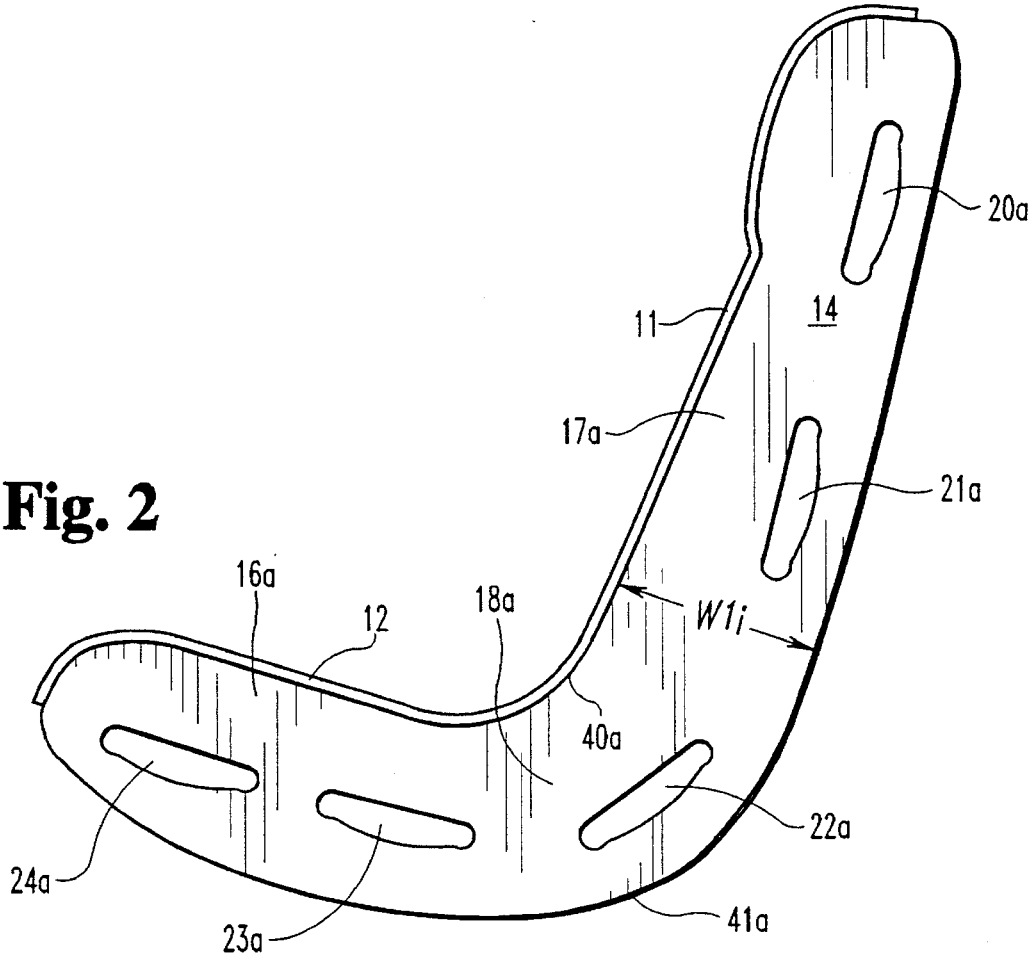
FIG. 2 is a side elevational view of the exercise chair of the present invention.
Figure 4:
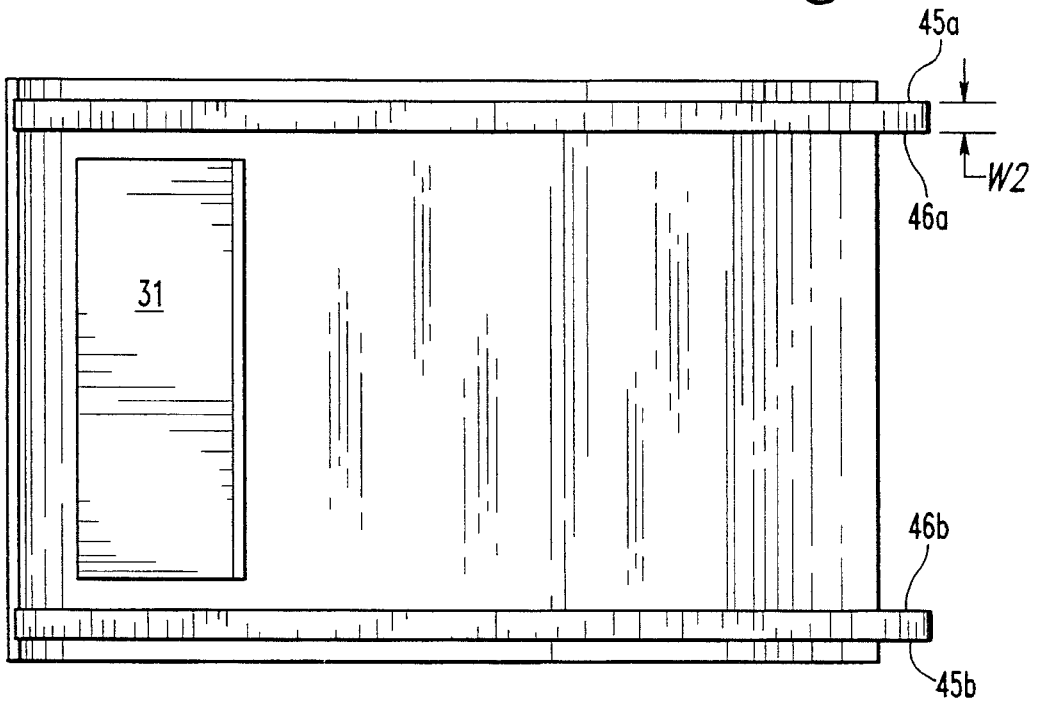
FIG. 4 is a bottom view of the chair of FIG. 1, showing the placement of the counterweight.
Figure 3:
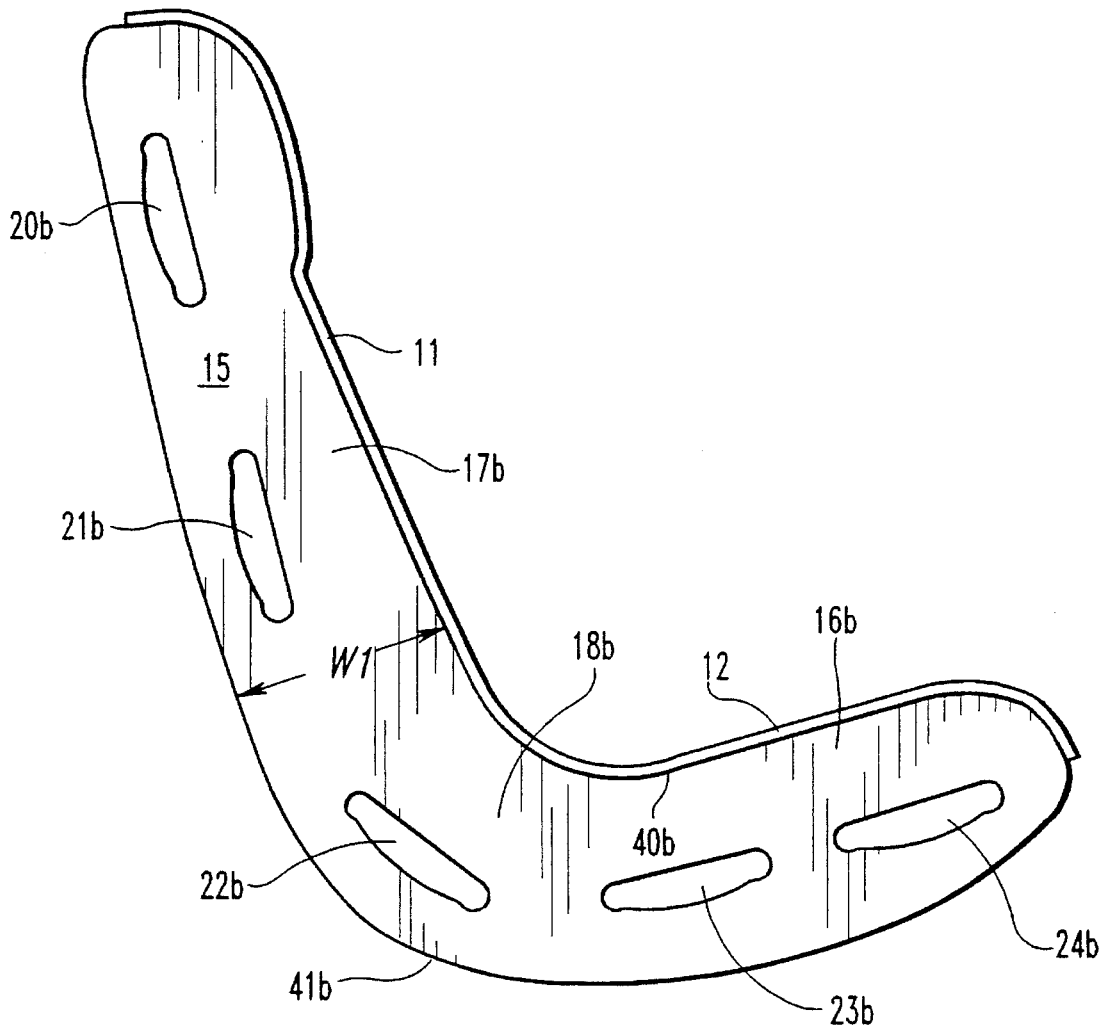
FIG. 3 is a second side elevational view of the exercise chair of FIG. 2.
Figure 5:
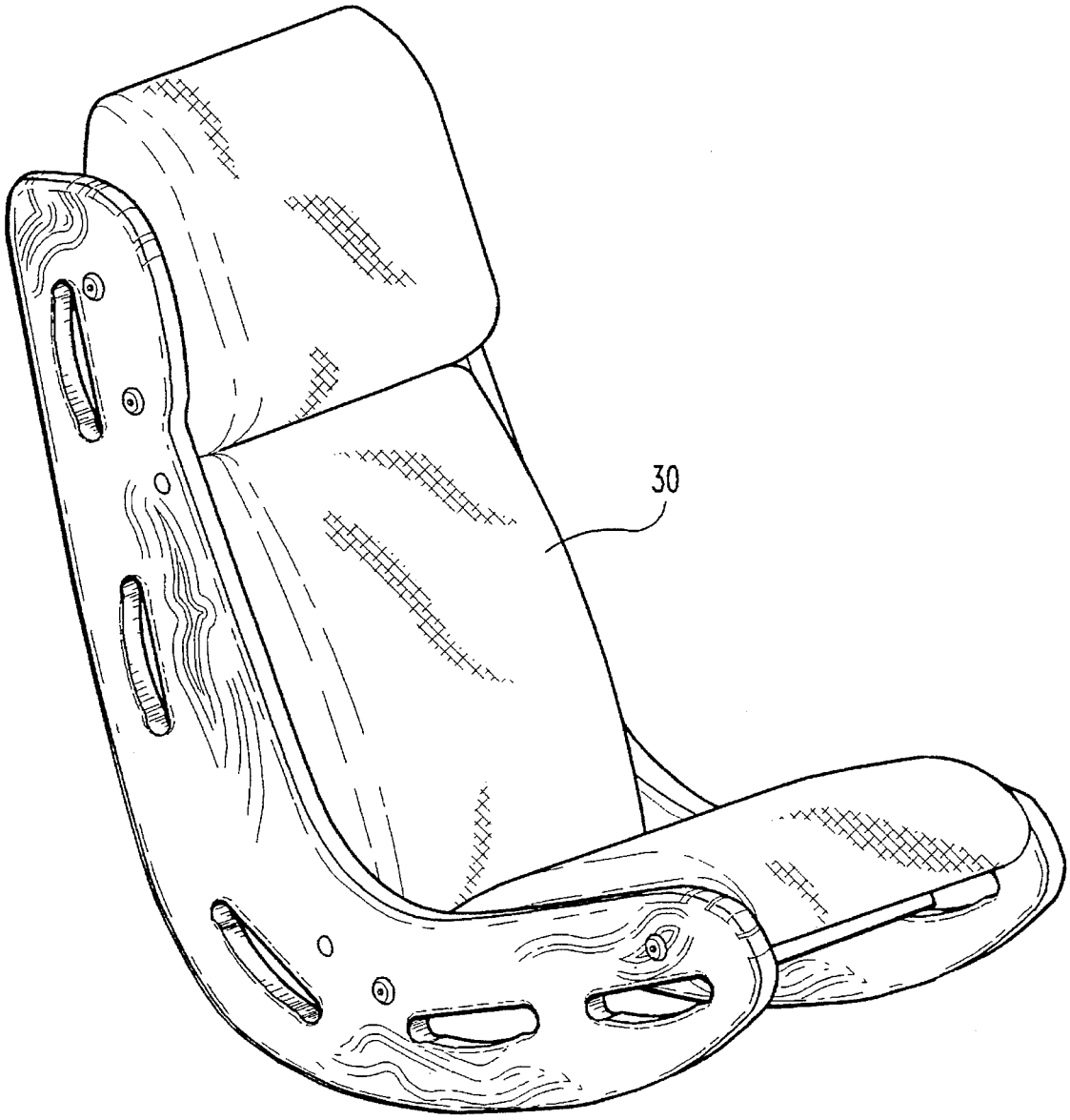
FIG. 5 is a perspective view of the exercise chair of the present invention according to a second preferred embodiment, with a cushioning means thereon.
Figure 6:
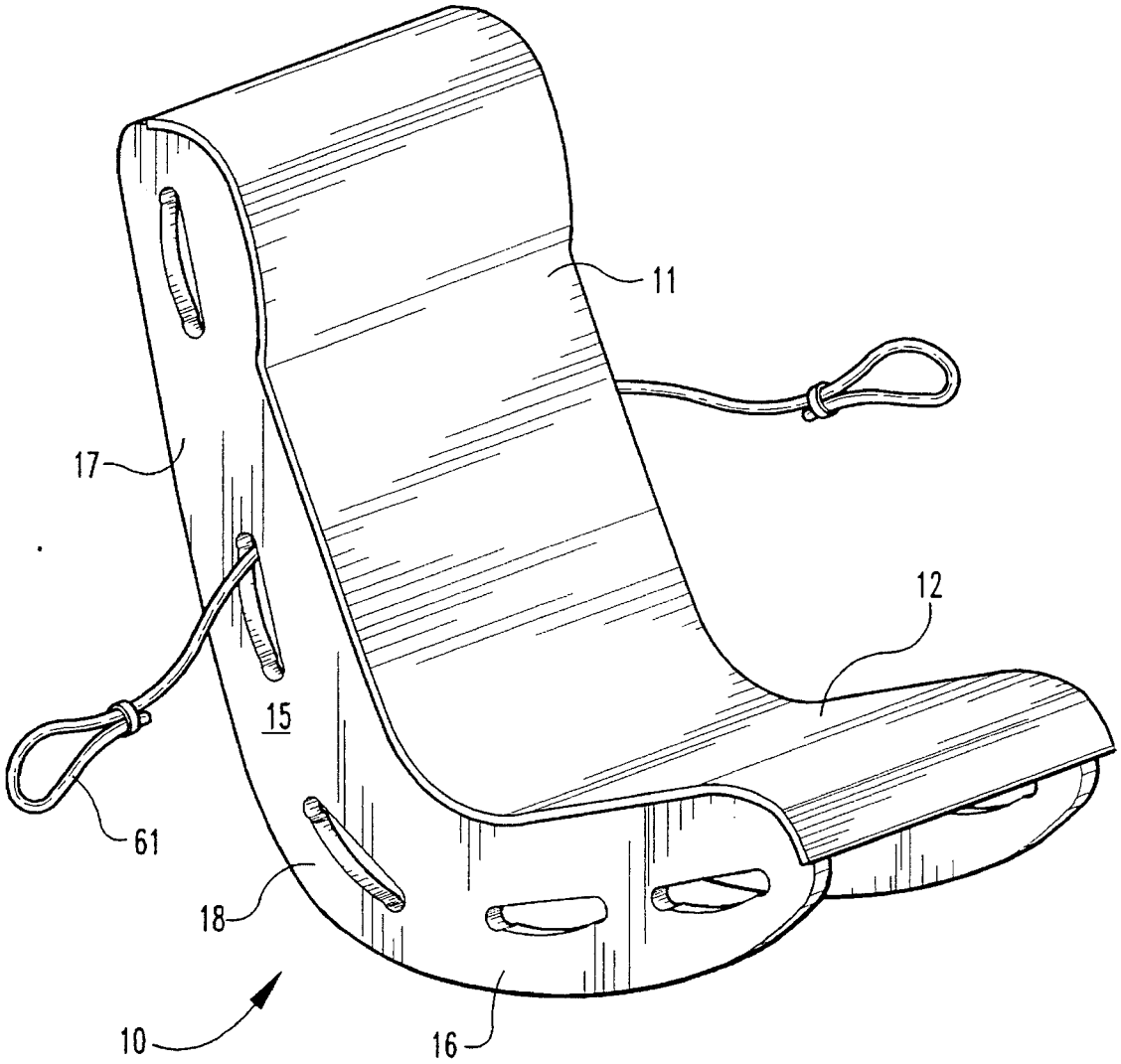
FIG. 6 shows the exercise chair of the present invention with an elastic band threaded through one pair of apertures to provide resistance exercise.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to the drawings, the exercise chair 10 of the present invention includes back member 11, seat member 12, and two rocking members. In the most preferred embodiments the two rocking members comprise first side member 14 and second side member 15. Each side member includes a short lower portion 16 adjacent to seat 12, and a long upper portion 17 adjacent to back 11 of exercise chair 10. Short lower portion 16 and long upper portion 17 are joined by an arcuate portion 18 so that the user may rock the device back and forth or rock backward until back member 11 engages the floor. Once in contact with the floor, the back member remains in said position without any physical effort on the part of the user, and the seat portion is elevated above the back. Accordingly, the user's feet are elevated substantially above the user's head.

It is to be appreciated that first side member 14 and second side member 15 are each generally L-shaped, although with an arcuate portion joining the two ends of the "L". In some embodiments the side members may more closely resemble a crescent with blunt, somewhat straightened ends or rounded ends. In all embodiments the side members provide smooth, easy rocking from a normal, seated position to an inverted, feet-elevated orientation.

The side members extend fully from the top of the exercise chair back to the front end of the exercise chair seat. Accordingly, the exercise chair effectively supports the frame of the average-sized adult user from the back of the head to the knee. Smaller or larger sizes may be fashioned to accommodate children or other users.

Each side member has an upper edge 40 which supports the chair back and seat. Each side member also has a lower edge 41 which acts as the rocking surface. The distance between lower edge 41 and the nearest point on upper edge 40 defines a side member width W1 for each point on lower member 41. In the region of the chair which is generally adjacent to the user's body, side member width W1 should be great enough to prevent a user's arms and elbows from touching the exercise surface when the user grips handles placed on the side members at apertures 24*a* and 24*b*.

It is also to be appreciated that each side member includes an outer face 45 and an inner face 46. The distance between these two faces defines a side member width W2. Side member width W2 should be great enough to provide a solid base of support and facilitate aggressive exercise by stabilizing the device when it is in use. In the most preferred embodiment of the device, first side member 14 and second side member 15 possess substantially similar dimensions.

As shown in the drawings, arcuate portions 18*a* and 18*b* of side members 14 and 15 respectively connect the short portions 16*a* and 16*b* and the long portions 17*a* and 17*b* of side members 14 and 15 so that seat member 13 and the back member 11 are positioned at an angle of between about 90° and 150° relative to each other. The present device avoids the painful jarring motion obtained when a user rocks back in an acutely-angled device, because the instant invention allows the user to roll the device backward slowly and comfortably. This feature makes the device safe for users of all age groups and skill levels.

First side member 14 and second side member 15 have handles 20, 21, 22, 23 and 24 which the user may grip for assistance during exercising. These handles may also be used to adjust and maintain the position of the apparatus relative to the user's anatomy. Handles 20, 21, 22, 23 and 24 are designed to accommodate differing arm lengths and to maintain the elbows in a wing configuration away from the sides of the user's body. This configuration effectively reduces the opportunity for collision of the elbows with the floor or exercise surface. Further, the handles make the device easier to move from one location to another.

A first pair of handles 20*a* and 20*b*, are positioned on the upper portion of each side member, near the user's head. This set of handles may be gripped to help slow the motion of the device as it is rocked back, and may be used to facilitate exercises such as vertical crunch-type sit-ups in which the user raises her lower body by tensing her abdominal muscles. Handle pairs 21, 22, 23 and 24 may be placed, one on each side member, anywhere from the region of the user's lower back to the user's knees. In the preferred structure, handles 21*a* and 21*b* are placed near the user's back, handles 22*a* and 22*b* are placed near the user's seat, handles 23*a* and 23*b* are placed near the user's mid-thigh area, and handles 24*a* and 24*b* are placed near the user's knees.

Handle pairs 20, 21, 22, 23 and 24 help the user stabilize his position while seated in the device, and are especially useful to help a user safely change position when the device is rocked back. The handle pairs of the present invention provide a significant improvement over the exercise chairs of the prior art.

Additionally, the handle pairs may accommodate auxiliary exercise aids such as stretchable elastic bands and/or stretchable tubing. In one preferred method of using the exercise chair, stretchable elastic bands 61 with a handle at each end are looped through a handle pair to provide exercise resistance to a user seated in the chair.

In one preferred embodiment the handles comprise "teardrop" shaped cutouts. The teardrop-shape provides substantial benefits over other shapes by enabling the user to grip the handle at a location that transfers the least shearing force to the handle surface. This provides a more secure grip and allows the user to exercise longer with increased comfort.

Figure 7:
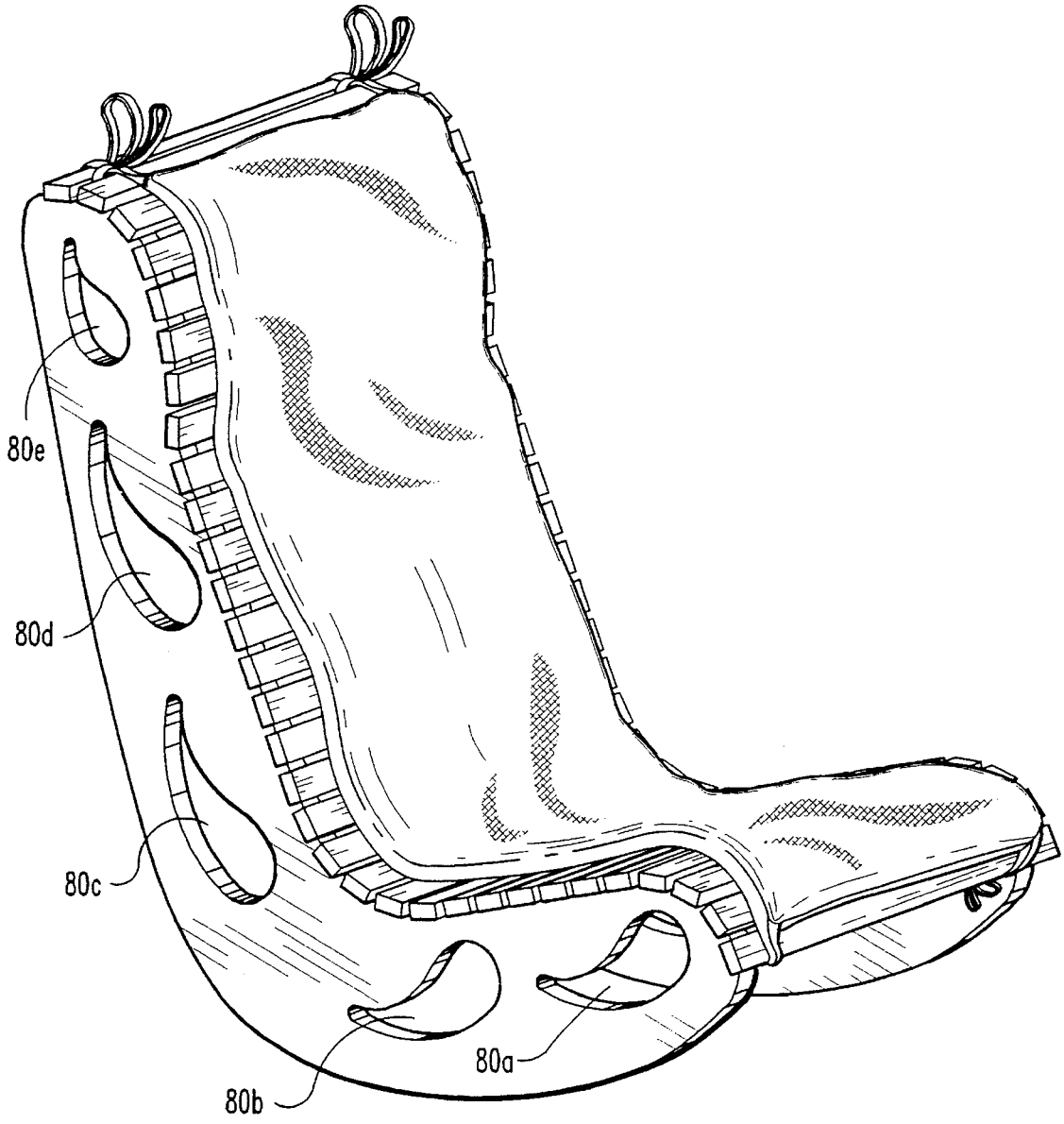
FIG. 7 is a perspective view of the exercise chair of the present invention according to a third preferred embodiment, showing the teardrop shaped handles.

Specifically, the shape of a cutout handle defines a set of vectors perpendicular to the gripping surface. Pulling in the direction of these vectors transfers the least shearing force to the gripping surface, and to the user's hands, making the grip more comfortable and secure. When the gripping surface is curved, such as with the teardrop shaped handles 80*a* through 80*e* of FIG. 7, a variety of directions may be selected as the direction of pull while still maintaining a direction of pull which is perpendicular to the gripping surface. Thus, shearing forces may be minimized by selectively positioning the user's hands in the teardrop-shaped cutout at a location which is generally perpendicular to the desired direction of pull. In this manner increased comfort and a more secure grip may be achieved. At the central edge of the teardrop nearest the seat, the radius of curvature is centered toward the seat, rather than away from the seat as would be the case in a conventional opening.

The small end of the teardrop may also be curved or otherwise adapted to position an elastic band. In this embodiment the small end of the cutout holds or positions an elastic band in a substantially fixed position to stabilize the band during exercise.

Back member 11 is designed to accommodate an average adult user's body from the back of the head to the base of the spine. The back member is preferably wide enough to comfortably accommodate the user's shoulders, and may be wide enough to give the user freedom to move around in the device. This latter construction is especially beneficial for users with arthritis who often need to change positions frequently in order to ease the discomfort of their condition. Alternatively, a back member just wide enough to cradle the shoulders may be preferred.

Seat member 12 is designed to support a user from the base of the spine to the knees. Here too, the seat member may be only as wide as the typical user's hips, or it may be wider to permit a user to move freely from side to side within the device. In the preferred embodiment, back member 11 is somewhat narrower than seat member 12.

A cushioning pad 30, which may be removable or non-removable, is shaped to fit between the curved sides and extend the length of the device from the head to the seat portion. This cushioning pad 30 may also possess a wedge-shaped portion, which may be detachable or non-detachable, that is curved to fit and placed on the back member in a position where it will support a user's lumbar spine. Cushioning pad 30 may be foam rubber, fiber, inflatable, water, or the like, depending on the user's specific needs.

A weight 31, which may be of wood or any other dense material, may be used as a counterweight to assist the user to return the seat member to its normal horizontal position in contact with the flat rocking surface. When the user wishes to return to a sitting position, she need only slightly lean forward and extend her arms forward until the weight 31 on the base of the seat member reaches a certain angle relative to the floor. Once this angle is obtained, the weight forces the device to rock forward easily and quickly. This feature is especially useful for the elderly and those with weak abdominal muscles who otherwise might be unable to obtain the momentum necessary to return the device to a vertical position. When the device is not being used for exercises or stress relief, the device may be used as a seating structure.

The preferred embodiment of the device may be used to perform sit-up, push-up, stretching, or isometric type exercises. The user desiring to perform any of these exercises first places the device on a flat rocking surface with the seat member oriented horizontally. The user then sits down on the seat member, raises his arms to grasp the first pair of handles 20 near the user's head, and leans backwards, causing the device to easily roll backwards up to 90°, depending on the degree of curvature of the arcuate member.

Once the back member contacts the flat rocking surface, the user's head, neck, and shoulders will be parallel to the floor or other supporting surface, and the rest of the body will naturally and comfortably assume a vertical position relative to the floor or other supporting surface. In this supine position, the user's arms can be used to perform isometric exercises such as grasping and releasing the various sets of handles 22, 23 and 24 placed in the arcuate or lower portions of the side member.

The user may also perform push-ups by tipping the chair onto its back and kneeling face downwards on the chair. With your knees on the arcuate portions of side edges 40*a* and 40*b*, and your arms either above or next to the back of the chair with your hands on the floor, push-ups may be performed by pushing up with the arms and rocking the device forward upon the arcuate portion of the sides. This type of push-up is far less stressful to the joints and muscles than the traditional push-up where the exerciser must push his entire body off the floor because the device, with its rocking capability, can follow the user's body throughout the range of motion providing support to the user's knees and upper body. Thus, the device provides a safer form of exercise than is obtained by traditional methods, and is accordingly useful for the elderly and those just beginning an exercise regimen.

The user may also perform sit-up type exercises using the device. By grasping any lower pair of handles 22, 23, or 24, and using a combination of abdominal and upper body strength to rock the user's body forward on the rocking surface, the user may exercise the abdominal muscles without the back strain associated with traditional sit-ups. Alternatively, the user may place his hands behind his head and, while in the supine position with his legs vertical to the supporting surface, exercise his abdominal muscles by performing crunch-type sit-ups.

Further, the user may engage in several different types of stretching exercises using the device. Such exercises include: (1) rotating the device until the user's legs are vertical relative to the rocking surface, then stretching the hamstrings and lower back muscles by lowering the feet towards the head, and (2) stretching over the back of the device while the seat member is in its normal resting position. Even when the user merely raises his feet and remains stationary in the device, he enjoys cardiovascular exercise, for the user's heart must pump harder than normal to pump the blood up to his feet.

Finally, this device may be used as a stress management tool. When a user's legs are raised above her head, blood flow is stimulated, thereby bathing the brain in oxygen and nutrients and yielding pleasant, relaxing sensations.

One preferred embodiment of the present invention is molded from plastic. Alternatively, the seat, back or sides may be made of metal, wood, or plastic tubing, and may be covered by canvas, cushioned pads, fabric, rubber, plastic, or the like. If the device is made of plastic, the handles are typically formed during the molding process. The sidewalls may be integral with said basic structure, or may be made removable for ease in transport, storage, assembly, and disassembly.

While the invention has been illustrated and described in detail in the drawings and foregoing description, the same are to be considered illustrative and not restrictive in character, it being understood that only the preferred embodiment has been shown and described and that all changes and modifications that come within the spirit of the invention are desired to be protected.

What is claimed is:

1. An exercise device for stimulating blood flow, comprising:

(a) a seat;

(b) a back;

(c) a first rockable side member;

(d) a second rockable side member; wherein each of said rockable side members consists of an upper portion adjacent to the back and a lower portion adjacent to the seat; wherein each upper portion is joined to its corresponding lower portion by an arcuate portion; each of said rockable side members further including a supporting surface and a rocking surface; wherein said seat member and said back member are mounted to the supporting surface, and the rocking surface is shaped to enable a user seated in the device to smoothly rock the device backward until the user's feet are elevated above the user's head; and further wherein the rocking surface is shaped to enable a user seated in the device to smoothly rock the device forward from its feet-elevated to its feet-lowered orientation; and (e) apertures in each of said side members, said apertures being shaped to enable a user to grip the device during exercise in a manner effective to stabilize the user in the exercise device, at least some of said apertures being located in the upper portion of the side members near a mid point between an end of the upper portion and the arcuate portion and said apertures being positioned rearward the back of the device.

2. The device of claim 1 with apertures shaped to allow the user to select a gripping position wherein the gripping surface is generally perpendicular to the direction of pull when pulling against the handle toward the user's shoulders.

3. The device of claim 2 wherein said apertures are teardrop shaped.

4. The device of claim 1, wherein said apertures are provided in the portion of the device near the user's head, thereby enabling the user to grip the device near the user's head while the user's feet are elevated, stabilizing the user in the exercise device.

5. The device of claim 1, and further including apertures for gripping the device near the user's seat while the user's feet are elevated, thereby stabilizing the user's seat in the exercise device.

6. The device of claim 1, and further including apertures for gripping the device near the user's knees while the user's feet are elevated, thereby stabilizing the user in the exercise device.

7. The device of claim 1, and further including apertures for gripping the device near the user's mid-thigh area while the user's feet are elevated, thereby stabilizing the user in the exercise device.

8. The device of claim 1, and further including apertures for gripping the device near the user's lower back while the user's feet are elevated, thereby stabilizing the user in the exercise device.

9. The device of claim 4, and further including apertures for gripping the device near the user's seat while the user's feet are elevated, thereby stabilizing the user's seat in the exercise device.

10. The device of claim 9, and further including apertures for gripping the device near the user's knees while the user's feet are elevated, thereby stabilizing the user in the exercise device.

11. The device of claim 10, and further including apertures for gripping the device near the user's mid-thigh area while the user's feet are elevated, thereby stabilizing the user in the exercise device.

12. The device of claim 11, and further including apertures for gripping the device near the user's lower back while the user's feet are elevated, thereby stabilizing the user in the exercise device.

13. The device of claim 1, and further including cushioning means for cushioning the user's seat and/or back.

14. The device of claim 1 in which the edge the nearest the seat of said first and second apertures has a radius of curvature which is centered toward the seat.

15. A device for use in stimulating blood flow, comprising:

(a) a seat member;

(b) a back member;

(c) a first curved side member, said first curved side member having a short portion, a long portion, an arcuate portion to permit a user to rock backward until the user's feet are elevated above the user's head, said first curved side member also including a first aperture near the user's head, said first aperture being positioned rearward of said back;

(d) a second curved side member, said second curved side member having a short portion, a long portion, and an arcuate portion to permit a user to rock the device back and forth on a flat rocking surface, said second curved side member also including a second aperture near the user's head, said second aperture being positioned rearward of said back;

said first curved side member and said second curved side member being shaped to allow a user to rock back and remain in a supine position; and (e) an elastic band having a first end and a second end, said elastic band being threaded through said first aperture and said aperture so that the first end and the second end are positioned in front of said exercise chair to provide exercise resistance to a user seated in the chair.

16. The device of claim 15 in which the edge nearest the seat of said first and said second apertures has a radius of curvature which is centered toward the seat.

17. The device of claim 15 wherein said first curved side member and said second curved side member are generally L-shaped.

18. The device of claim 15 and further including cushioning means for cushioning the user's seat and/or back.

19. The device of claim 15 wherein said first curved side member and said second curved side member each have a width W1, wherein W1 is measured from a lower edge of one of said curved side members to a nearest point on an upper edge of the curved side member, great enough to prevent a user's arms and elbows from touching the exercise surface when the user grips those side members through their apertures.

20. The device of claim 15 wherein said first curved side member and said second curved side member each have a thickness T1 great enough to provide a solid base of support and facilitate aggressive exercise by stabilizing the device when it is in use.

21. An exercise device for stimulating blood flow, comprising:

(a) a seat;

(b) a back;

(c) a first rockable side member;

(d) a second rockable side member; wherein each of said rockable side members consists of an upper portion adjacent to the back and a lower portion adjacent to the seat; wherein each upper portion is joined to its corresponding lower portion by an arcuate portion; each of said rockable side members further including a supporting surface and a rocking surface; wherein said seat member and said back member are mounted to the supporting surface, and the rocking surface is shaped to enable a user seated in the device to smoothly rock the device backward until the user's feet are elevated above the user's head; and further wherein the rocking surface is shaped to enable a user seated in the device to smoothly rock the device forward from its feet-elevated to its feet-lowered orientation; and (e) apertures in each of said side members, said apertures being shaped to enable a user to grip the device during exercising in a manner effective to stabilize the user in the exercise device, at least some of said apertures being located in the upper portion of the side members near an end of the upper portion in the area of the user's head and said apertures being positioned rearward of the back of the device.

22. The device of claim 21, and further including apertures for gripping the device near the user's seat while the user's feet are elevated, thereby stabilizing the user's seat in the exercise device.

23. The device of claim 21, and further including apertures for gripping the device near the user's knees while the user's feet are elevated, thereby stabilizing the user in the exercise device.

24. The device of claim 21, and further including apertures for gripping the device near the user's mid-thigh area while the user's feet are elevated, thereby stabilizing the user in the exercise device.

25. The device of claim 21, and further including apertures for gripping the device near the user's lower back while the user's feet are elevated, thereby stabilizing the user in the exercise device.

26. The device of claim 22, and further including apertures for gripping the device near the user's knees while the user's feet are elevated, thereby stabilizing the user in the exercise device.

27. The device of claim 26, and further including apertures for gripping the device near the user's mid-thigh area while the user's feet are elevated, thereby stabilizing the user in the exercise device.

28. The device of claim 27, and further including apertures for gripping the device near the user's lower back while the user's feet are elevated, thereby stabilizing the user in the exercise device.

29. A device for use in stimulating blood flow, comprising:

(a) a seat member;

(b) a back member;

(c) a first curved side member; said first curved side member having a short portion, a long portion, and an arcuate portion to permit a user to rock backward until the user's feet are elevated above the user's head, said first curved side member also including a first aperture near the user's back, said first aperture being positioned rearward of said back member;

(d) a second curved side member, said second curved side member having a short portion, a long portion, and an arcuate portion to permit a user to rock the device back and forth on a flat rocking surface, said second curved side member also including a second aperture near the user's back, said second aperture being positioned rearward of said back member;

said first curved side member and said second curved side member being shaped to allow a user to rock back and remain in a supine position; and (e) an elastic band having a first end and a second end, said elastic band being threaded through said first aperture and said second apertures so that the first and the second end are positioned in front of said exercise chair to provide exercise resistance to a user seated in the chair.

* * * * *